US011134785B1

(12) United States Patent
Smatt

(10) Patent No.: US 11,134,785 B1
(45) Date of Patent: Oct. 5, 2021

(54) VIBRATING FOOT REST

(71) Applicant: Janice Smatt, Tamarac, FL (US)

(72) Inventor: Janice Smatt, Tamarac, FL (US)

( * ) Notice: Subject to any disclaimer, the term of this patent is extended or adjusted under 35 U.S.C. 154(b) by 369 days.

(21) Appl. No.: 16/285,391

(22) Filed: Feb. 26, 2019

(51) Int. Cl.
*A47C 16/02* (2006.01)
*A47C 20/00* (2006.01)
*A61H 23/02* (2006.01)

(52) U.S. Cl.
CPC ..... *A47C 16/02* (2013.01); *A47C 20/021* (2013.01); *A61H 23/0254* (2013.01)

(58) Field of Classification Search
CPC ..... A47C 16/02; A47C 16/025; A47C 20/021; A47C 12/02; A61H 23/0254
USPC ..... 5/648; 248/677, 678, 118.1; 601/57
See application file for complete search history.

(56) References Cited

U.S. PATENT DOCUMENTS 2,351,849 A * 6/1944 Wells ..... A45D 44/10 4/520
2,943,620 A * 7/1960 Sibert ..... A61H 23/02 601/18
3,284,817 A * 11/1966 Landwirth ..... A61G 7/0755 5/647
3,505,994 A * 4/1970 Smith, Jr. ..... A61F 5/0193 602/24
3,853,121 A * 12/1974 Mizrachy ..... A61H 15/0078 601/48
3,938,205 A * 2/1976 Spann ..... A47C 20/027 5/632
3,946,451 A * 3/1976 Spann ..... A61G 7/0755 5/650
4,475,542 A * 10/1984 Brossard ..... A61G 13/009 5/630
4,513,736 A * 4/1985 Thurber ..... A61H 23/0218 601/15
4,660,548 A * 4/1987 Bucher ..... A61H 23/0254 601/61
4,910,818 A * 3/1990 Grabill ..... A47C 20/021 297/423.17
5,002,046 A * 3/1991 Scott ..... A61F 5/04 602/36
5,134,739 A * 8/1992 Gaffe ..... A61G 7/0755 5/624
5,222,979 A * 6/1993 Brossard ..... A61F 5/01 5/648
D345,797 S * 4/1994 Gardner ..... 5/648
5,448,790 A * 9/1995 Saro ..... A47C 17/045 5/427
5,454,993 A * 10/1995 Kostich ..... A47C 20/021 264/46.4
D386,643 S * 11/1997 Farrell ..... D6/596
D399,694 S 10/1998 Laidlaw
(Continued)

FOREIGN PATENT DOCUMENTS

WO 1994015553 7/1994

*Primary Examiner* — Nkeisha Smith
(74) *Attorney, Agent, or Firm* — Kyle A. Fletcher, Esq.

(57) ABSTRACT

The vibrating foot rest is configured for use with a patient. The vibrating foot rest is a therapeutic device. The vibrating foot rest massages the legs of the patient. The vibrating foot rest comprises a foam wedge and a master circuit. The foam wedge contains the master circuit. The foam wedge is secured to the legs of the patient. The master circuit is a vibrating structure that massages the legs of the patient.

15 Claims, 5 Drawing Sheets

(56) References Cited

U.S. PATENT DOCUMENTS 5,827,205 A * 10/1998 Iwamoto ..... A61H 23/0218 601/78
6,260,221 B1 7/2001 Grabell
6,315,744 B1 * 11/2001 Inaba ..... A61H 9/0078 601/148
6,478,380 B2 * 11/2002 Ehrlich ..... A47C 16/025 297/423.41
6,551,260 B2 * 4/2003 Suh ..... A61H 7/004 601/103
6,668,401 B2 * 12/2003 Waters ..... A47C 21/00 5/504.1
6,735,798 B1 * 5/2004 Sekizawa ..... A47C 17/045 5/630
6,935,697 B2 * 8/2005 Conlon ..... A47C 16/02 297/423.41
6,968,585 B2 11/2005 Shaw
7,150,057 B1 12/2006 Santiago
8,408,652 B1 * 4/2013 Mobley, Sr. ..... A47C 16/025 297/423.44
8,479,333 B2 * 7/2013 Gould ..... A61G 7/0755 5/648
8,695,135 B2 * 4/2014 Berube ..... A47C 7/021 5/648
9,084,704 B2 * 7/2015 Oberst ..... A61G 7/075
9,717,640 B1 * 8/2017 Pleasants ..... A61H 1/0218
10,226,551 B2 * 3/2019 Richey ..... A61L 31/18
10,617,584 B1 * 4/2020 Moudy ..... A61G 7/0755
2002/0088057 A1 * 7/2002 Wassilefsky ..... A61G 7/0755 5/648
2004/0121888 A1 * 6/2004 Williams ..... A63B 21/028 482/121
2008/0092297 A1 * 4/2008 Davis ..... A47C 20/021 5/648
2008/0178390 A1 * 7/2008 DuDonis ..... A47C 20/021 5/632
2009/0188047 A1 * 7/2009 Morse ..... A61H 1/0292 5/655.9
2009/0189432 A1 * 7/2009 Anikin ..... A47C 27/088 297/423.41
2009/0192028 A1 * 7/2009 Shank ..... A63B 26/00 482/148
2010/0022925 A1 * 1/2010 Anikin ..... A61H 23/0263 601/55
2010/0262050 A1 * 10/2010 Gasparovich ..... A47D 13/02 601/57
2011/0193392 A1 * 8/2011 Gane ..... B60N 3/06 297/423.4
2013/0160211 A1 * 6/2013 Klein ..... A61G 13/123 5/648
2015/0250326 A1 * 9/2015 Riccabona ..... A47C 20/021 5/636
2016/0095776 A1 * 4/2016 Batiste ..... A61G 7/0755 5/648
2019/0262207 A1 * 8/2019 Lee ..... A61H 1/00
2020/0093275 A1 * 3/2020 Dolev ..... A47C 7/748
2020/0261296 A1 * 8/2020 Kilbey ..... A61G 13/1245
2021/0077855 A1 * 3/2021 Walko ..... A61D 3/00

* cited by examiner

VIBRATING FOOT REST

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical and veterinary science including therapy apparatus, more specifically, a vibration massage device with a mechanical drive.

SUMMARY OF INVENTION

The vibrating foot rest is configured for use with a patient. The vibrating foot rest is a therapeutic device. The vibrating foot rest massages the legs of the patient. The vibrating foot rest comprises a foam wedge and a master circuit. The foam wedge contains the master circuit. The foam wedge is secured to the legs of the patient. The master circuit is a vibrating structure that massages the legs of the patient.

These together with additional objects, features and advantages of the vibrating foot rest will be readily apparent to those of ordinary skill in the art upon reading the following detailed description of the presently preferred, but nonetheless illustrative, embodiments when taken in conjunction with the accompanying drawings.

In this respect, before explaining the current embodiments of the vibrating foot rest in detail, it is to be understood that the vibrating foot rest is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the vibrating foot rest.

It is therefore important that the claims be regarded as including such equivalent construction insofar as they do not depart from the spirit and scope of the vibrating foot rest. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
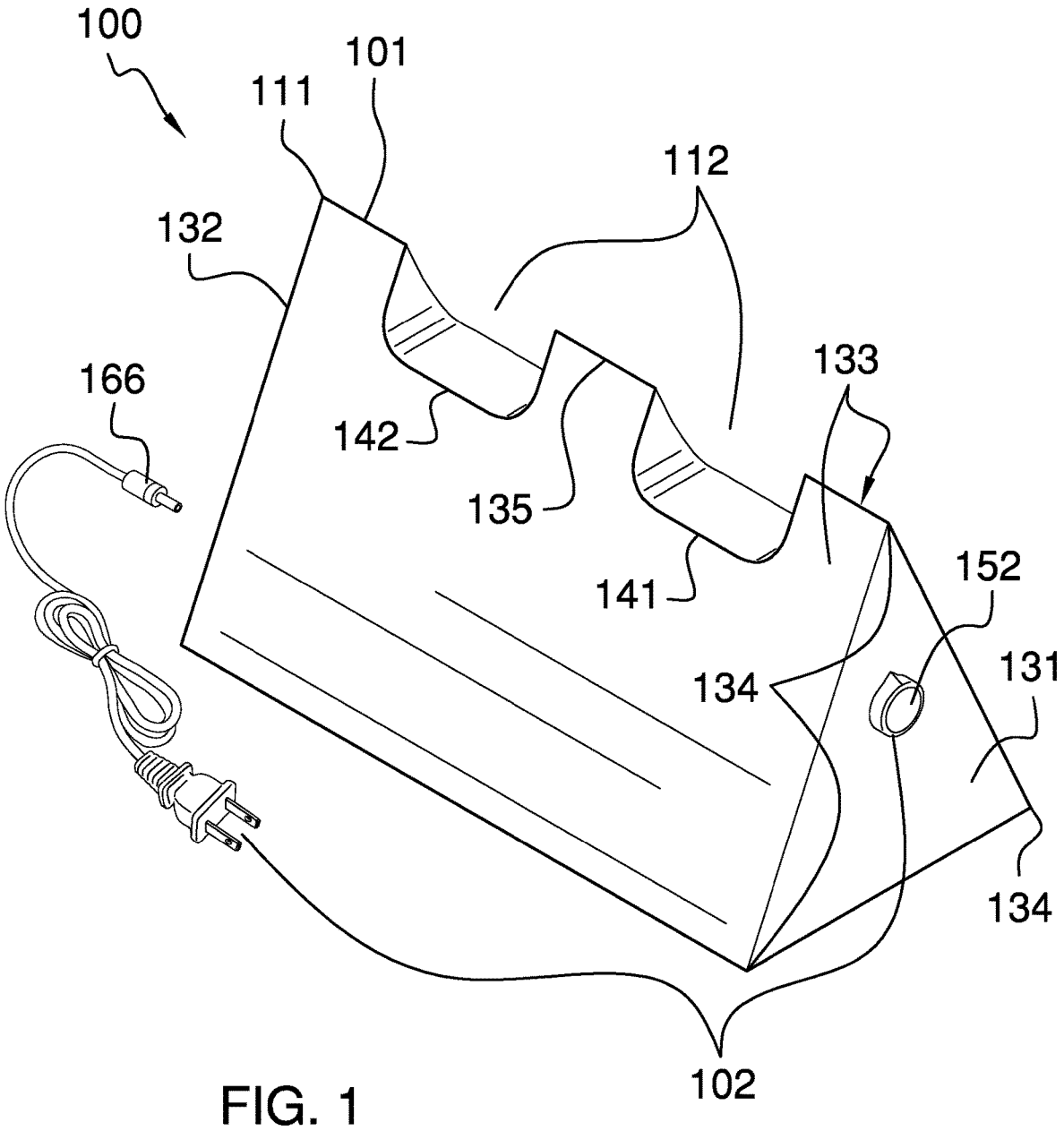
FIG. 1 is a perspective view of an embodiment of the disclosure.
Figure 2:
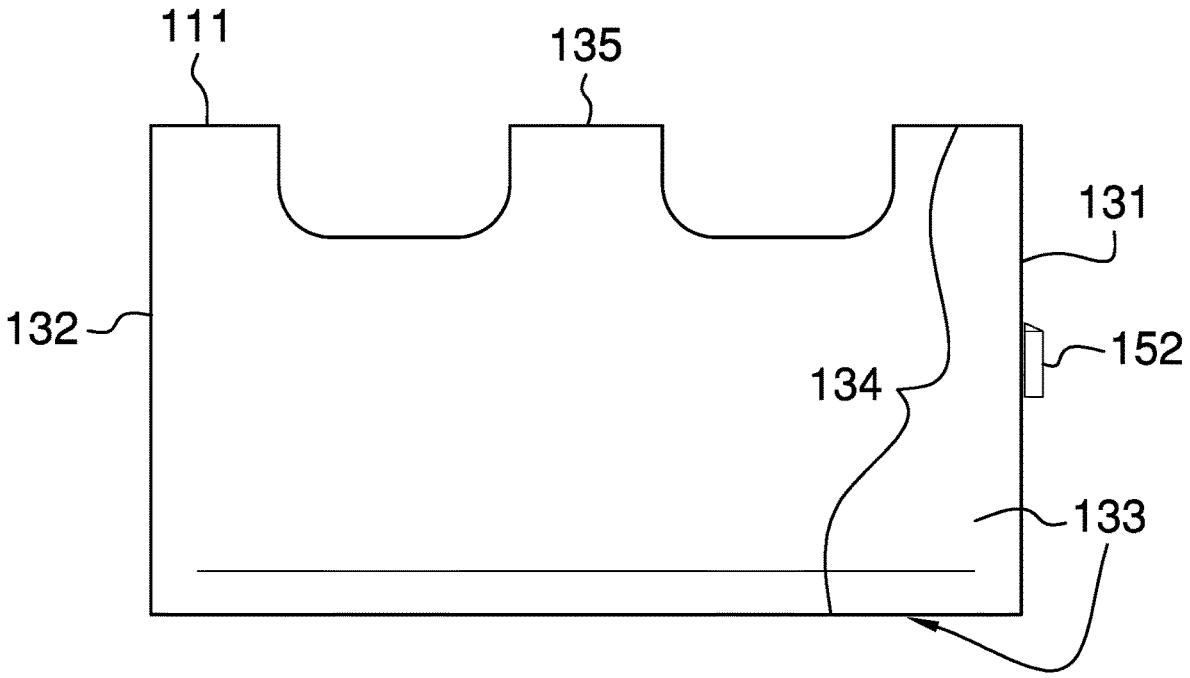
FIG. 2 is a lateral view of an embodiment of the disclosure.
Figure 3:
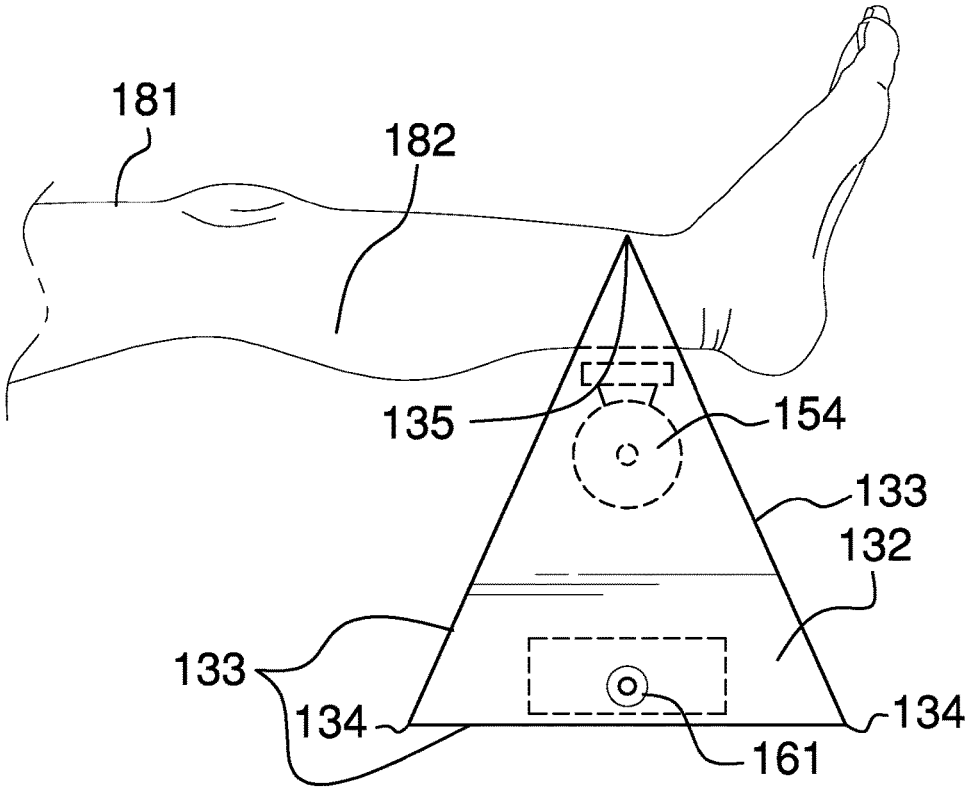
FIG. 3 a rear view of an embodiment of the disclosure.
Figure 4:
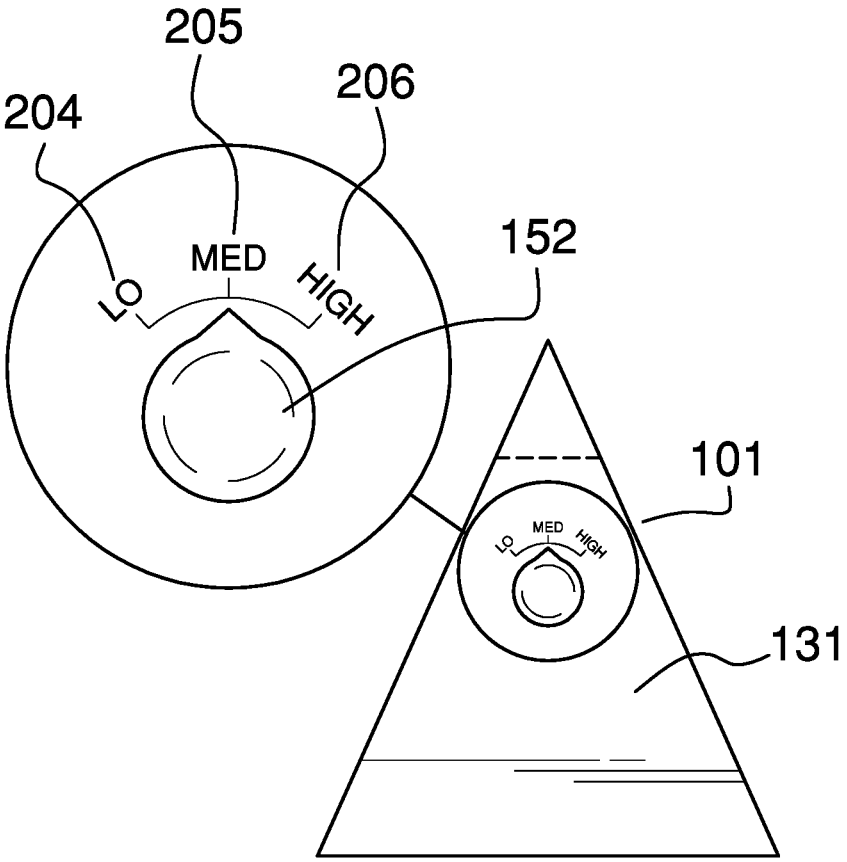
FIG. 4 is a front view of an embodiment of the disclosure.
Figure 5:
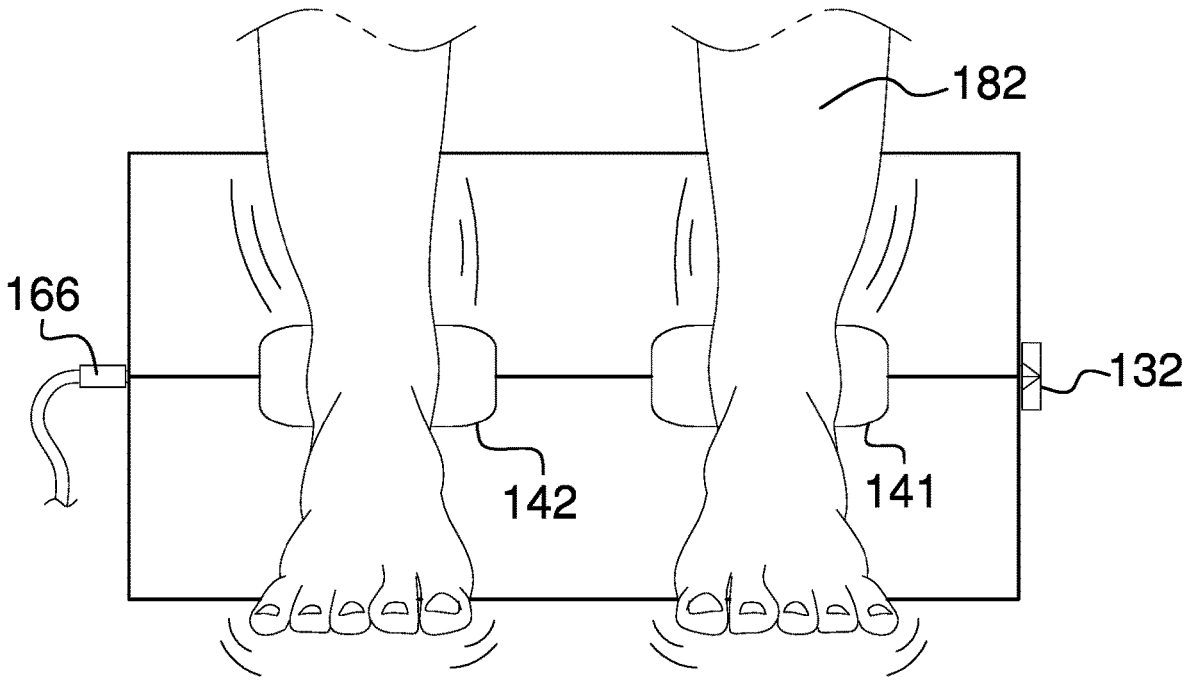
FIG. 5 is an in-use view of an embodiment of the disclosure.
Figure 6:
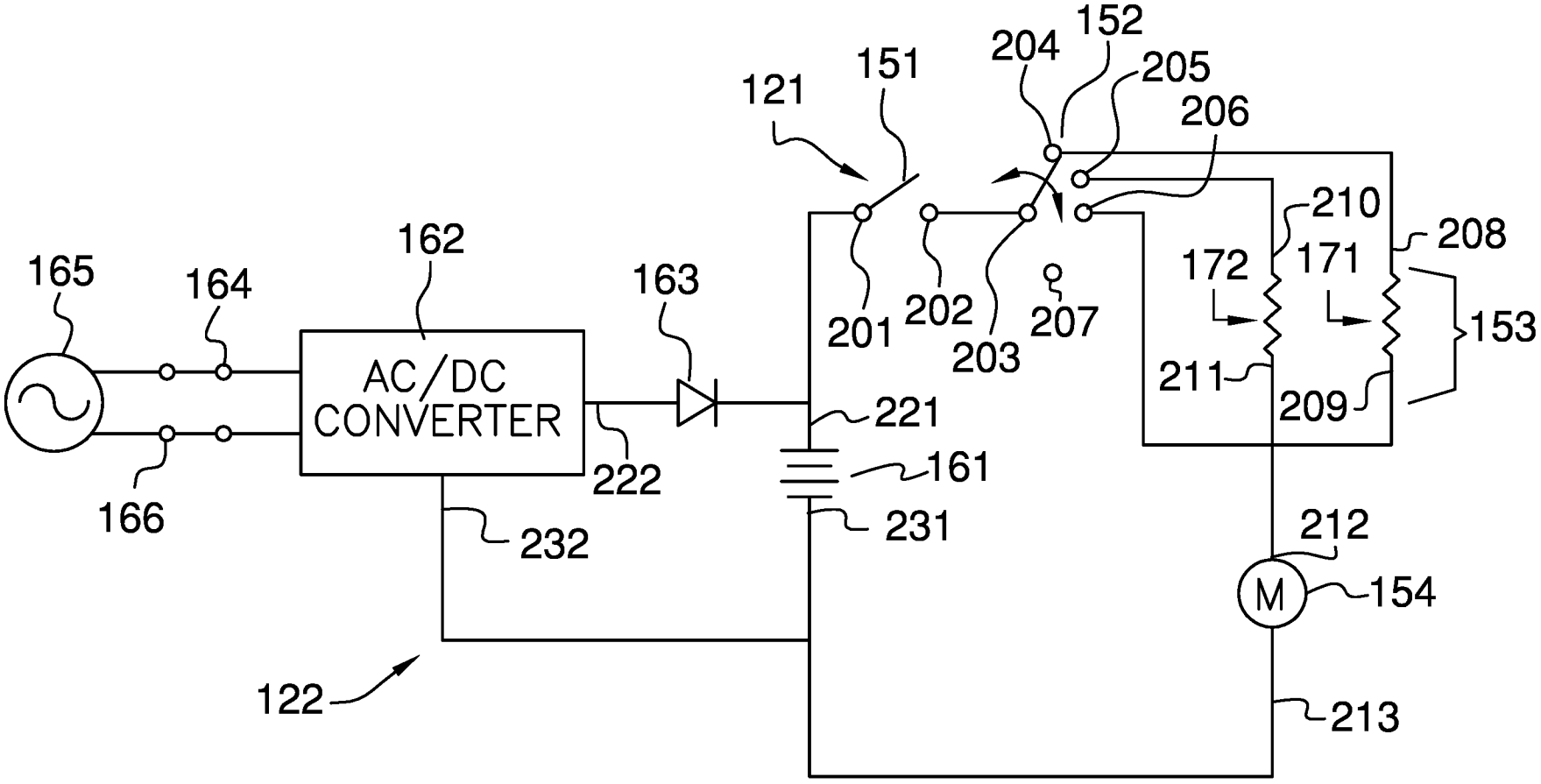
FIG. 6 is a schematic view of an embodiment of the disclosure.

Detailed reference will now be made to one or more potential embodiments of the disclosure, which are illustrated in FIGS. 1 through 6.

The vibrating foot rest 100 (hereinafter invention) is configured for use with a patient 181. The invention 100 is a therapeutic device. The invention 100 massages the legs 182 of the patient 181. The invention 100 comprises a foam wedge 101 and a master circuit 102. The foam wedge 101 contains the master circuit 102. The foam wedge 101 is secured to the legs 182 of the patient 181. The master circuit 102 is a vibrating structure that massages the legs 182 of the patient 181.

The foam wedge 101 is a prism-shaped structure. The foam wedge 101 is a semi-rigid structure with an elastic nature. The foam wedge 101 supports the legs 182 of the patient 181 above a horizontal supporting surface. The foam wedge 101 receives the legs 182 of the patient 181 in a negative space such that the master circuit 102 can knead the legs 182 of the patient 181 for therapeutic purposes. In the first potential embodiment of the disclosure, the foam wedge 101 has a triangular prism shape. The foam wedge 101 is further formed from a polyurethane foam. The foam wedge 101 comprises a prism structure 111 and a plurality of leg notches 112.

The prism structure 111 is the primary structure of the foam wedge 101. The prism structure 111 is a semi-rigid structure with an elastic nature. The legs 182 of the patient 181 are placed on and in the prism structure 111. In the first potential embodiment of the disclosure, the prism structure 111 has a triangular prism shape. The prism structure 111 comprises a first end 131, a second end 132, a plurality of lateral faces 133, and a plurality of brinks 134.

The first end 131 is the first congruent end of the two congruent ends of the prism shape that forms the prism structure 111. The second end 132 is the second congruent end of the two congruent ends of the prism shape that forms the prism structure 111. The second end 132 is geometrically identical to the first end 131. In the first potential embodiment of the disclosure, the first end 131 and the second end 132 have a triangular shape.

The plurality of lateral faces 133 are the faces of the prism shape of the prism structure 111 that form the lateral face of the prism structure 111. The plurality of lateral faces 133 attach the first end 131 to the second end 132. Each of the plurality of lateral faces 133 has a rectangular shape.

Each of the plurality of brinks 134 is an edge formed by the intersection of two adjacent lateral faces selected from the plurality of lateral faces 133. The plurality of brinks 134 further comprises a supporting brink 135. The supporting brink 135 is a brink selected from the plurality of brinks 134. The supporting brink 135 forms the superior edge of the prism structure 111 of the foam wedge 101 when the invention 100 is used normally.

Each of the plurality of leg notches 112 is a negative space that is formed in the prism structure 111. Each of the plurality of leg notches 112 is sized to receive one of the legs 182 of the patient 181. The plurality of leg notches 112 position the legs 182 of the patient 181 such that the position of the master circuit 102 relative to the legs 182 allows the master circuit 102 to knead the legs 182. Each of the plurality of leg notches 112 are formed in the supporting brink 135 of the prism structure 111. The plurality of leg notches 112 further comprises a first leg notch 141 and a second leg notch 142.

The first leg notch 141 is the leg notch selected from the plurality of leg notches 112 that is proximal to the first end 131 of the prism structure 111. The first leg notch 141 is sized to receive one of the legs 182 of the patient 181. The second leg notch 142 is the leg notch selected from the plurality of leg notches 112 that is proximal to the second end 132 of the prism structure 111. The second leg notch 142 is sized to receive one of the legs 182 of the patient 181.

The master circuit 102 is an electrical circuit. The master circuit 102 generates a vibration used to knead the legs 182 of the patient 181 for therapeutic purposes. The foam wedge 101 contains the master circuit 102. The master circuit 102 comprises a therapeutic circuit 121 and a power circuit 122.

The therapeutic circuit 121 is an electrical sub-circuit of the master circuit 102. The therapeutic circuit 121 generates the vibration used to knead the legs 182 of the patient 181 during therapy. The therapeutic circuit 121 comprises a master switch 151, a selection switch 152, a plurality of limit resistors 153, and a vibration motor 154. The master switch 151 comprises a first lead 201 and a second lead 202. The selection switch 152 comprises a third lead 203, a fourth lead 204, a fifth lead 205, a sixth lead 206, and a seventh lead 207. The vibration motor 154 comprises a twelfth lead 212 and a thirteenth lead 213.

The master switch 151 is a maintained switch. The master switch 151 is a single pole single throw electrical switch. The master switch 151 controls the flow of electricity from the power circuit 122 into the therapeutic circuit 121. The master switch 151 is the power switch of the master circuit 102. The use of a single pole single throw electrical for this purpose is well-known and documented in the electrical arts.

The selection switch 152 is a maintained switch. The selection switch 152 is a single pole four throw electrical. The selection switch 152 controls the flow of electricity from the master switch 151 into the vibration motor 154. The rotational speed of the vibration motor 154 is determined by the selection of the throw of the selection switch 152. The use of a single pole four throw electrical for this purpose is well-known and documented in the electrical arts.

The selection switch 152 forms an electrical connection selected from the group consisting of a first throw, a second throw, a third throw, and a fourth throw.

The first throw of the selection switch 152 describes the electrical connection between the third lead 203 and the fourth lead 204 formed by the selection switch 152. The first throw of the selection switch 152 operates the vibration motor 154 at its slowest speed.

The second throw of the selection switch 152 describes the electrical connection between the third lead 203 and the fifth lead 205 formed by the selection switch 152. The second throw of the selection switch 152 operates the vibration motor 154 at an intermediate speed.

The third throw of the selection switch 152 describes the electrical connection between the third lead 203 and the sixth lead 206 formed by the selection switch 152. The third throw of the selection switch 152 operates the vibration motor 154 at its fastest speed.

The fourth throw of the selection switch 152 describes the electrical connection between the third lead 203 and the seventh lead 207 formed by the selection switch 152. The fourth throw of the selection switch 152 disables the operation of the vibration motor 154.

Each of the plurality of limit resistors 153 is an electrical resistor. The resistance presented by any first limit resistor 171 selected from the plurality of limit resistors 153 is different from the resistance presented by any second limit resistor 172 selected from the plurality of limit resistors 153. Each of the plurality of limit resistors 153 electrically connects a throw selected from the selection switch 152 to the vibration motor 154. Each of the plurality of limit resistors 153 limits the flow of electricity into the vibration motor 154. The speed of rotation of the vibration motor 154 is controlled by the value of resistance presented by each limit resistor selected from the plurality of limit resistors 153.

The plurality of limit resistors 153 comprises a first limit resistor 171 and a second limit resistor 172. The first limit resistor 171 comprises an eighth lead 208 and a ninth lead 209. The second limit resistor 172 comprises a tenth lead 210 and an eleventh lead 211. The first limit resistor 171 is a resistor that electrically connects the first throw of the selection switch 152 to the vibration motor 154. The second limit resistor 172 is a resistor that electrically connects the second throw of the selection switch 152 to the vibration motor 154. The Ohmic value of the first limit resistor 171 is greater than the Ohmic value of the second limit resistor 172.

The vibration motor 154 generates a vibration proximal to the legs 182 of the patient 181 such that the generated vibration kneads the legs 182 in a therapeutic fashion. The vibration motor 154 is defined in greater detail elsewhere in this disclosure.

The power circuit 122 is an electrochemical device. The power circuit 122 provides the electrical energy required to operate the therapeutic circuit 121 to the therapeutic circuit 121. The power circuit 122 comprises a battery 161, an AC/DC converter 162, a diode 163, a charging port 164, and an external power source 165. The battery 161 is further defined with a first positive terminal 221 and a first negative terminal 231. The AC/DC converter 162 is further defined with a second positive terminal 222 and a second negative terminal 232. The external power source 165 further comprises a charging plug 166.

The battery 161 is a commercially available rechargeable battery 161. The chemical energy stored within the rechargeable battery 161 is renewed and restored through the use of the AC/DC converter 162. The AC/DC converter 162 is an electrical circuit that reverses the polarity of the rechargeable battery 161 and provides the energy necessary to reverse the chemical processes that the rechargeable battery 161 initially used to generate the electrical energy. This reversal of the chemical process creates a chemical potential energy that will later be used by the rechargeable battery 161 to generate electricity.

The AC/DC converter 162 attaches to an external power source 165 using charging port 164 and a charging plug 166. The AC/DC converter 162 receives electrical energy from the external power source 165 through the charging plug 166. The charging plug 166 plugs into the charging port 164 to transport electrical energy to the AC/DC converter 162. The diode 163 is an electrical device that allows current to flow in only one direction. The diode 163 installs between the rechargeable battery 161 and the AC/DC converter 162 such that electricity will not flow from the first positive terminal 221 of the rechargeable battery 161 into the second positive terminal 222 of the external power source 165.

The battery 161, the AC/DC converter 162, the diode 163, and the external power source 165 are defined in further detail elsewhere in this disclosure. In the first potential embodiment of the disclosure, this disclosure assumes that the external power source 165 is the national electric grid.

The following four paragraphs describe the assembly of the therapeutic circuit 121 of the master circuit 102.

The first positive terminal 221 of the battery 161 electrically connects to the first lead 201 of the master switch 151. The second lead 202 of the master switch 151 electrically connects to the third lead 203 of the selection switch 152.

The fourth lead 204 of the selection switch 152 electrically connects to the eighth lead 208 of the first limit resistor 171. The fifth lead 205 of the selection switch 152 electrically connects to the tenth lead 210 of the second limit resistor 172. The sixth lead 206 of the selection switch 152 electrically connects to the twelfth lead 212 of the vibration motor 154. The seventh lead 207 of the selection switch 152 forms no electrical connections.

The ninth lead 209 of the first limit resistor 171 electrically connects to the twelfth lead 212 of the vibration motor 154. The eleventh lead 211 of the second limit resistor 172 electrically connects to the twelfth lead 212 of the vibration motor 154.

The second negative terminal 232 of the AC/DC converter 162 electrically connects to the first negative terminal 231 of the battery 161. The second negative terminal 232 of the AC/DC converter 162 electrically connects to the thirteenth lead 213 of the vibration motor 154.

The following definitions were used in this disclosure:

AC: As used in this disclosure, AC is an acronym for alternating current.

AC/DC Converter: As used in this disclosure, an AC/DC converter is an electrical device that converts an AC voltage into a regulated DC voltage by rectifying and regulating the AC voltage. Method to design and build AC/DC converters are well-known in the electrical arts. The AC/DC converter is further defined with a positive terminal, a negative terminal, and a power input.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Battery: As used in this disclosure, a battery is a chemical device consisting of one or more cells, in which chemical energy is converted into electricity and used as a source of power. Batteries are commonly defined with a positive terminal and a negative terminal.

Brink: As used in this disclosure, a brink refers to the discontinuous edge or line formed by the intersection of a first plane or surface and a second plane or surface wherein a cant exists between the first plane or surface and the second plane or surface.

Carbamate: As used in this disclosure, a carbamate is a functional group consisting of an O—(C=O)—N structure. Carbamate is informally referred to as urethane.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Copolymer: As used in this disclosure, a copolymer is a polymer formed from two or more repeating molecules (also referred to as monomers).

Correspond: As used in this disclosure, the term correspond is used as a comparison between two or more objects wherein one or more properties shared by the two or more objects match, agree, or align within acceptable manufacturing tolerances.

DC: As used in this disclosure, DC is an acronym for direct current.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. Specifically, the sum of the surface areas of two ends of the prism-shaped object that forms the disk is greater than the surface area of the lateral face of the prism-shaped object that forms the disk. In this disclosure, the ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

External Power Source: As used in this disclosure, an external power source is a source of the energy that is externally provided to enable the operation of the present disclosure. Examples of external power sources include, but are not limited to, electrical power sources and compressed air sources.

Foam: As used in this disclosure, foam is a mass of gas-filled spaces, commonly referred to as bubbles, which can be formed: 1) on or in a liquid or gel; or, 2) in a solid material.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Kneading: As used in this disclosure, to knead refers to the folding, pressing a stretching of a collection of materials for the purpose of forming a uniform mass. The term kneading may further refer to a motion similar to the kneading motion that is used during massage activities.

Lead: As used in this disclosure, a lead is a conductor that is physically used to electrically connect an electrical component into a larger circuit assembly.

Limit Resistor: As used in this disclosure, a limit resistor is an electrical resistor that is used to limit the flow of electric current through an electrical circuit.

Maintained Switch: A used in this disclosure, a maintained switch is a switch that maintains the position that was set in the most recent switch actuation. A maintained switch works in an opposite manner to a momentary switch.

Massage: As used in this disclosure, a massage is a therapeutic process wherein the muscles of the body are kneaded for the purpose of aiding circulation and relaxing the muscles.

Monomer: As used in this disclosure, a monomer refers to a molecular structure that bonds to itself in a repeating manner to form a polymer.

Motor: As used in this disclosure, a motor refers to the method of transferring energy from an external power source into rotational mechanical energy.

National Electric Grid: As used in this disclosure, the national electric grid is a synchronized and highly interconnected electrical network that distributes energy in the form of electric power from a plurality of generating stations to consumers of electricity. The national electric grid is a commercially available source of AC electrical power. The national electric grid is regulated by an appropriate authority. The national electric grid sells electrical power for use by an electrical load. The national electric grid invoices for electrical power based on the total energy consumed by the electrical load. The national electric grid measures the energy consumption of an electrical load with an electrical meter.

Negative Space: As used in this disclosure, negative space is a method of defining an object through the use of open or empty space as the definition of the object itself, or, through the use of open or empty space to describe the boundaries of an object.

Notch: As used in this disclosure, a notch is: 1) an indentation formed in an edge; or 2) a cavity or aperture formed within a surface.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Patient: As used in this disclosure, a patient is a person who is designated to receive a medical treatment, therapy or service. The term patient may be extended to an animal when used within the context of the animal receiving veterinary treatment or services Plug: As used in this disclosure, a plug is an electrical termination that electrically connects a first electrical circuit to a second electrical circuit or a source of electricity. As used in this disclosure, a plug will have two or three metal pins.

Poles, Throws, and Switches: As used in this disclosure, the terms pole and throw are descriptions associated with an electrical switch. A pole refers to an electrical circuit the switch feeds electrical current into. The number of poles associated with the switch refers to the maximum number of independent circuits a switch can theoretically support. Because the circuits supported by the poles of a switch can be interconnected, a switch will often support fewer independent electrical circuits than the actual number of poles. The number of throws associated with a switch refers to the maximum number of electrical connections that can be made within an individual pole of the switch.

Polymer: As used in this disclosure, a polymer refers to a molecular chain that comprises multiple repeating units known as monomers. The repeating unit may be an atom or a molecular structure.

Polyurethane: As used in this disclosure, a polyurethane is a copolymer wherein the one or more monomer chains are linked together carbamates.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Resistor: As used in this disclosure, a resistor is a well-known and commonly available electrical device that inhibits the flow of electricity through an electric circuit. Within an electric circuit processing alternating currents, the resistor will not affect the phase of the alternating current. A current flowing through a resistor will create a voltage across the terminals of the resistor.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Terminal: As used in this disclosure, a terminal is the end point of a conductor. A terminal can be the conducting wire itself or may have attached to is a device designed to facilitate an electrical connection.

Therapeutic: As used in this disclosure, therapeutic is an adjective that refers to a medical, ameliorative, or hygienic substance, process, or procedure.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Vibration Motor: As used in this disclosure, a vibration motor is an electric motor that rotates an unbalanced weight in such a manner that the electric motor vibrates during operation. The vibration can be varied by varying the rotational speed of the vibration motor. The rotational speed is varied by varying the electric current flowing through the vibration motor.

Wedge: As used in this disclosure, a wedge is a triangular prism.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A therapeutic leg rest comprising:

a foam wedge and a master circuit;

wherein the foam wedge contains the master circuit;

wherein the therapeutic leg rest is configured for use with a patient;

wherein the therapeutic leg rest is a therapeutic device;

wherein the therapeutic leg rest massages the legs of the patient;

wherein the foam wedge is secured to the legs of the patient;

wherein the master circuit massages the legs of the patient;

wherein the foam wedge is a prism-shaped structure;

wherein the foam wedge is a semi-rigid structure with an elastic nature;

wherein the foam wedge receives the legs of the patient in a negative space;

wherein the master circuit is an electrical circuit;

wherein the master circuit generates a vibration used to knead the legs of the patient;

wherein the foam wedge comprises a prism structure and a plurality of leg notches;

wherein the plurality of leg notches are formed in the prism structure;

wherein the plurality of leg notches is the negative space that receives the legs of the patient;

wherein the master circuit comprises a therapeutic circuit and a power circuit;

wherein the therapeutic circuit and the power circuit are electrically interconnected;

wherein the therapeutic circuit is an electrical sub-circuit of the master circuit;

wherein the therapeutic circuit generates the vibration used to knead the legs of the patient during therapy;

wherein the power circuit is an electrochemical device;

wherein the power circuit provides the electrical energy required to operate the therapeutic circuit.

2. The therapeutic leg according to claim 1 wherein the prism structure comprises a first end, a second end, a plurality of lateral faces, and a plurality of brinks;

wherein a first end is the first congruent end of two congruent ends of the prism shape that forms the prism structure;

wherein a second end is the second congruent end of the two congruent ends of the prism shape that forms the prism structure;

wherein the second end is geometrically identical to the first end;

wherein the plurality of lateral faces are faces of the prism shape of the prism structure that form a lateral face of the prism structure;

wherein the plurality of lateral faces attach the first end to the second end;

wherein each of the plurality of brinks is an edge formed by an intersection of two adjacent lateral faces selected from the plurality of lateral faces.

3. The therapeutic leg according to claim 2 wherein the plurality of brinks further comprises a supporting brink;

wherein the supporting brink is a brink selected from the plurality of brinks;

wherein the supporting brink forms a superior edge of the prism structure of the foam wedge.

4. The therapeutic leg according to claim 3 wherein each of the plurality of leg notches is a negative space that is formed in the prism structure;

wherein each of the plurality of leg notches is sized to receive one of the legs of the patient;

wherein the plurality of leg notches position the legs of the patient such that a position of the master circuit relative to the legs allows the master circuit to knead the legs;

wherein each of the plurality of leg notches are formed in the supporting brink of the prism structure.

5. The therapeutic leg according to claim 4 wherein the therapeutic circuit comprises a master switch, a selection switch, a plurality of limit resistors, and a vibration motor;

wherein the master switch, the selection switch, the plurality of limit resistors, and the vibration motor are electrically interconnected;

wherein the master switch is further defined a first lead and a second lead;

wherein the selection switch is further defined a third lead, a fourth lead, a fifth lead, a sixth lead, and a seventh lead;

wherein the vibration motor comprises a twelfth lead and a thirteenth lead.

6. The therapeutic leg according to claim 5 wherein the master switch is a maintained switch;

wherein the selection switch is a maintained switch;

wherein the master switch is a single pole single throw electrical switch;

wherein the selection switch is a single pole four throw electrical;

wherein the master switch controls the flow of electricity from the power circuit into the therapeutic circuit;

wherein the selection switch controls the flow of electricity from the master switch into the vibration motor.

7. The therapeutic leg according to claim 6 wherein each of the plurality of limit resistors is an electrical resistor;

wherein a resistance presented by any first limit resistor selected from the plurality of limit resistors is different from a resistance presented by any second limit resistor selected from the plurality of limit resistors;

wherein each of the plurality of limit resistors electrically connects a throw selected from the selection switch to the vibration motor;

wherein each of the plurality of limit resistors limits a flow of electricity into the vibration motor;

wherein a speed of rotation of the vibration motor is controlled by a value of resistance presented by each limit resistor selected from the plurality of limit resistors.

8. The therapeutic leg according to claim 7 wherein the selection switch forms an electrical connection selected from the group consisting of a first throw, a second throw, a third throw, and a fourth throw;

wherein the first throw of the selection switch is an electrical connection between the third lead and the fourth lead formed by the selection switch;

wherein the first throw of the selection switch operates the vibration motor at its slowest speed;

wherein the second throw of the selection switch is an electrical connection between the third lead and the fifth lead formed by the selection switch;

wherein the second throw of the selection switch operates the vibration motor at an intermediate speed;

wherein the third throw of the selection switch is an electrical connection between the third lead and the sixth lead formed by the selection switch;

wherein the third throw of the selection switch operates the vibration motor at its fastest speed;

wherein the fourth throw of the selection switch is an electrical connection between the third lead and the seventh lead formed by the selection switch;

wherein the fourth throw of the selection switch disables an operation of the vibration motor.

9. The therapeutic leg according to claim 8 wherein the plurality of limit resistors comprises the first limit resistor and the second limit resistor;

wherein the first limit resistor is further defined with an eighth lead and a ninth lead;

wherein the second limit resistor is further defined a tenth lead and an eleventh lead;

wherein the first limit resistor is a resistor that electrically connects the first throw of the selection switch to the vibration motor;

wherein the second limit resistor is a resistor that electrically connects the second throw of the selection switch to the vibration motor;

wherein an Ohmic value of the first limit resistor is greater than an Ohmic value of the second limit resistor.

10. The therapeutic leg according to claim 9 wherein the power circuit comprises a battery, an AC/DC converter, a diode, a charging port, and an external power source;

wherein the battery, the AC/DC converter, the diode, the charging port, and the external power source are electrically interconnected;

wherein the battery is further defined with a first positive terminal and a first negative terminal;

wherein the AC/DC converter is further defined with a second positive terminal and a second negative terminal.

11. The therapeutic leg according to claim 10 wherein the battery is a rechargeable battery;

wherein the AC/DC converter is an electrical circuit that reverses a polarity of the rechargeable battery;

wherein the external power source further comprises a charging plug;

wherein the AC/DC converter attaches to an external power source using charging port and the charging plug;

wherein the AC/DC converter receives electrical energy from the external power source through the charging plug;

wherein the charging plug plugs into the charging port to transport electrical energy to the AC/DC converter;

wherein the diode is an electrical device that allows current to flow in only one direction;

wherein the diode installs between the rechargeable battery and the AC/DC converter such that electricity will not flow from a first positive terminal of the rechargeable battery into a second positive terminal of the external power source.

12. The therapeutic leg according to claim 11 wherein the first positive terminal of the battery electrically connects to the first lead of the master switch;

wherein the second lead of the master switch electrically connects to the third lead of the selection switch;

wherein the fourth lead of the selection switch electrically connects to the eighth lead of the first limit resistor;

wherein the fifth lead of the selection switch electrically connects to the tenth lead of the second limit resistor;

wherein the sixth lead of the selection switch electrically connects to the twelfth lead of the vibration motor;

wherein the seventh lead of the selection switch forms no electrical connections;

wherein the ninth lead of the first limit resistor electrically connects to the twelfth lead of the vibration motor;

wherein the eleventh lead of the second limit resistor electrically connects to the twelfth lead of the vibration motor;

wherein the second negative terminal of the AC/DC converter electrically connects to the first negative terminal of the battery;

wherein the second negative terminal of the AC/DC converter electrically connects to the thirteenth lead of the vibration motor.

13. The therapeutic leg according to claim 12 wherein the plurality of leg notches further comprises a first leg notch and a second leg notch;

wherein the first leg notch is a leg notch selected from the plurality of leg notches that is proximal to the first end of the prism structure;

wherein the second leg notch is a leg notch selected from the plurality of leg notches that is proximal to the second end of the prism structure.

14. The therapeutic leg according to claim 13 wherein the external power source is the national electric grid.

15. The therapeutic leg according to claim 14 wherein the prism structure has a triangular prism shape;

wherein the foam wedge is further formed from a polyurethane foam.

* * * * *